US005410098A

United States Patent [19]

Ito

[11] Patent Number: 5,410,098

[45] Date of Patent: Apr. 25, 1995

[54] AUTOMATIC ACCOMPANIMENT APPARATUS PLAYING AUTO-CORRECTED USER-SET PATTERNS

[75] Inventor: Yoshihisa Ito, Hamamatsu, Japan

[73] Assignee: Yamaha Corporation, Hamamatsu, Japan

[21] Appl. No.: 114,380

[22] Filed: Aug. 30, 1993

[30] Foreign Application Priority Data

Aug. 31, 1992 [JP] Japan ..... 4-232494

[51] Int. Cl.[6] ..... G10H 1/38; G10H 1/42; G10H 1/46

[52] U.S. Cl. ..... 84/613; 84/637; 84/669

[58] Field of Search ..... 84/610, 611, 634–637, 84/650–651, 666–669, 712–715

[56] References Cited

U.S. PATENT DOCUMENTS 4,887,504 12/1989 Okamoto et al. ..... 84/715
5,216,188 6/1993 Shibukawa ..... 84/637
5,220,122 6/1993 Shibukawa ..... 84/669
5,270,479 12/1993 Kondo ..... 84/635
5,278,348 1/1994 Eitaki et al. ..... 84/636
5,322,966 6/1994 Shimata ..... 84/637

FOREIGN PATENT DOCUMENTS 61-292690 12/1986 Japan .
2179690 7/1990 Japan .

*Primary Examiner*—Vit W. Miska
*Attorney, Agent, or Firm*—Spensley Horn Jubas & Lubitz

[57] ABSTRACT

An automatic accompaniment apparatus employs a chord designating section, a pattern memory, special operation designating section, a pattern read out section, a note conversion section and a tone generator. The chord designating section designates a root and a type of a chord. The pattern memory stores a performance pattern containing note data which designate tone pitches of musical tones. The pattern read out section sequentially reading out the note data from the pattern memory durring the automatic accompaniment. The note conversion section carrying out a note correction operation corresponding to the type designated by the chord designating section on the note data read out by the pattern read out section when the special operation is not designated. In contrast, the note conversion section outputs the note data read out from the pattern memory when the special operation is designated by the special operation designating section. The tone generator generates musical tone signals based on the note data outputted by the note conversion section.

14 Claims, 12 Drawing Sheets

| | C | C# | D | D# | E | F | F# | G | G# | A | A# | B |
|---|---|---|---|---|---|---|---|---|---|---|---|---|
| maj7 | 0 | 0 | 0 | 0 | 0 | -1 | 0 | 0 | 0 | 0 | 0 | 0 |
| M | 0 | 0 | 0 | 0 | 0 | -1 | 0 | 0 | 0 | 0 | 0 | 1 |
| m | 0 | 0 | 0 | -1 | -1 | 0 | 0 | 0 | 0 | -2 | 0 | -1 |
| m7 | 0 | 0 | 0 | -1 | -1 | 0 | -1 | 0 | 0 | 1 | 0 | -1 |
| 7 | 0 | 0 | -2 | 0 | 0 | 0 | 0 | 0 | 0 | -2 | 0 | -1 |
| 7sus4 | 0 | 0 | -2 | 2 | 1 | 0 | -1 | 0 | -1 | 0 | 0 | -1 |
| IIm7/V | 0 | 0 | -2 | 2 | 1 | 0 | -1 | 0 | -1 | 0 | 0 | -1 |
| IV/V | 0 | 0 | -2 | 2 | 1 | 0 | -1 | 0 | -1 | 0 | 0 | -1 |

| | C | C# | D | D# | E | F | F# | G | G# | A | A# | B |
|---|---|---|---|---|---|---|---|---|---|---|---|---|
| maj7 | 0 | 0 | 0 | 0 | 0 | -1 | 0 | 0 | 0 | 0 | 0 | 0 |
| M | 0 | 0 | 0 | 0 | 0 | -1 | 0 | 0 | 0 | 0 | 0 | 1 |
| m | 0 | 0 | 0 | -1 | -1 | 0 | 0 | 0 | 0 | -2 | 0 | -1 |
| m7 | 0 | 0 | 0 | -1 | -1 | 0 | -1 | 0 | 0 | 1 | 0 | -1 |
| 7 | 0 | 0 | -2 | 0 | 0 | 0 | 0 | 0 | 0 | -2 | 0 | -1 |
| 7sus4 | 0 | 0 | -2 | 2 | 1 | 0 | -1 | 0 | -1 | 0 | 0 | -1 |
| IIm7/V | 0 | 0 | -2 | 2 | 1 | 0 | -1 | 0 | -1 | 0 | 0 | -1 |
| IV/V | 0 | 0 | -2 | 2 | 1 | 0 | -1 | 0 | -1 | 0 | 0 | -1 |

AUTOMATIC ACCOMPANIMENT APPARATUS PLAYING AUTO-CORRECTED USER-SET PATTERNS

BACKGROUND OF THE INVENTION

1. Field of the Invention

The present invention relates to automatic accompaniment apparatuses which perform automatic accompaniments based on chord data which designate chords to be generated.

2. Background Art

Conventionally, automatic accompaniment apparatuses are known which are called as chord sequencers. In these chord sequencers, a series of chord data, each one of which designates a chord to be generated, are stored in accordance with the progress of a musical piece. When performing the chord accompaniment, the chord data are sequentially read out and the chord accompaniment is automatically performed based on the read out chord data.

In the automatic accompaniment, fundamental patterns, each one of which contains a series of notes, are defined beforehand and the notes of the fundamental patterns are converted into the other notes which are in harmony with the chord designated by the read out chord data. There are chord backing patterns (chord performance patterns) and bass patterns (bass performance patterns) as the fundamental patterns.

In the chord performance, the configuration of a chord is generally determined based on the root and the type. Therefore, the root data and the type data are used for designating the root and the type of the chord to be generated. There are special cases in which a chord containing a special bass tone is to be generated. The chord having such a special configuration is called as on-bass chord. When the on-bass chord is to be generated, the on-bass data is used together with the root data and the type data to designate the generation of the on-bass chord and to designate the special bass tone which is to be included in the on-bass chord.

In the chord accompaniment, the root and the type of the chord is designated by the chord data and a fundamental pattern corresponding to the designated chord type is regenerated. Some notes of the fundamental pattern thus regenerated are then converted into the other notes so that the configuration of the notes of the fundamental pattern conform with the designated type. The notes thus converted are then shifted upward or downward by a pitch shift value corresponding to the designated root.

In the bass performance, the bass tones are generated based on the general bass patterns when no on-bass data is given. In contrast, when on-bass data are designated to generate the on-bass chord, the bass tones are generated based on special bass patterns which are defined beforehand for only the on-bass chords.

The fundamental patterns define the configurations of the notes of the chords for a few chord types. The fundamental patterns are not prepared for the other chord types such as measure-sevens (Maj7), sevens (7) and minor sevens (m7). When generating a chord, the notes defined by the fundamental pattern corresponding to the designated chord type are converted to the other notes having a configuration which are in harmony with the designated chord. The note conversion is carried out based on a note conversion table.

The other type of automatic accompaniment apparatus is known which is capable of programming desired fundamental patterns. The user can perform a desired accompaniment having rich variations by using the apparatus (reference: Japanese Patent Application Laid-Open No. Sho 61-292690). In this type of automatic accompaniment apparatus, some operations are carried out in order to overcome a musical disadvantage.

For example of such a disadvantage, there is a case in which the user makes a fundamental pattern based the previous prepared fundamental pattern for the chord Cmaj7 and the user designates the same chord Cmaj7 as the chord to be generated. In this case, the notes of the fundamental pattern for Cmaj7 should be used with no note conversion. But, if the pattern made by the user contain the note F, the chord makes a musical disadvantage because such a tone is not defined in musical scale. The note conversion table is made so as to overcome such a musical disadvantage. When a chord is designated and the fundamental pattern corresponding to the designated chord makes a musical disadvantage, the notes of the fundamental pattern are converted based on the note conversion table even if the designated chord is identical to the chord corresponding to the fundamental pattern. In the above case, the tone F included in the fundamental pattern is converted to the other note based on the note conversion table.

In this manner, the notes of the fundamental pattern are automatically converted to the other notes based on the note conversion table so as to make no problem even if the automatic accompaniment apparatus is used by the user who does not specifically understand the configuration of the apparatus.

However, there are cases in which the users who have a much talent in the musical art require to generate a special chord containing a note which is not defined in musical scale in order to obtain a characteristic sound. In the conventional apparatus, however, when the fundamental pattern contains a note which is not defined in musical scale, such a note is automatically converted to the other note even if the user does not wish such a conversion. Thus, the conventional apparatuses do not satisfy such a requirement of the user.

Furthermore, the conventional apparatus has an another problem with respect to the designation of the on-bass chord. The on-bass chord is basically designated in order to generate one of the on-bass chords which are defined. However, there are cases in which the on-bass chord is designated by the user in order to generate an agent chord. More specifically, in this case, the user designates the on-bass chord having a chord type in order to generate the other chord, the chord type of which is different from the chord type of the on-bass chord. For example, the on-bass chord Dm7/G (Dm7 on G: "/" means "on") is used in the key C. But, the Dm7/G is usually used as the agent chord of G7sus4. The reason is as follows:

In the on-bass chord Dm7/G, the chord Dm7 consists of the element tones re, fa, ra and do, and the element tones are to be on the bass tone so. Therefore, the element tones of the on-bass chord Dm/G7 G are as so, re, fa, ra and do. On the other hand, the chord G7sus4 is made by modifying the element tones of the chord G7. More specifically, the chord G7 consists of the element tones so, si, re and fa. In these element tones, the element tone si is replaced by the suspended fourth tone, i.e., the tone do to form the chord G7sus4. Therefore, the element tones of the chord G7sus4 are defined as so, do, re and fa. Thus, if the ornament ra is added to the chord G7sus4, the added result equals the element tones of the on-bass chord Dm7/G. The on-bass chord Dm7/G contains the tone ra which is act as the ornament in the key C. But, when considering the musical characteristics of the chords, the on-bass chord Dm7/G is a chord close to the chord G7sus4. And when considering the role of the chords in the chord progression, the role of the chord Dm7/G is same as the role of the chord G7sus4. Therefore, the on-bass chord Dm7/G is used for designating the agent chord of the chord G7sus4 which is more decorative than the chord G7sus4.

In the conventional apparatus, however, the on-bass chord Dm7/G is subjected to the note conversion even if the user designates the on-bass chord as the agent chord of the chord G7sus4. Therefore, the conversion may make the chord which is not in harmony with the other chords in the musical piece of the key G. The same problem may be established with respect to the other on-bass chords which arc used for designating the agent chords. For example, the on-bass chords F/G and Dm7/F are respectively used for designating the agent chords of the chords G7sus4 and F6.

SUMMARY OF THE INVENTION

In consideration of the above, it is an object of the present invention to provide an automatic accompaniment apparatus which satisfies the following requirements:

(1) The user can select whether the notes of the fundamental pattern made by the user are to be subjected to the note conversion or not.

(2) The user can perform the natural accompaniment even if he does not skilled in the automatic accompaniment.

(3) The user skilled in the automatic accompaniment can program the automatic accompaniment which has a rich variation at will.

It is the other object of the present invention to provide an automatic accompaniment apparatus capable of processing the on-bass chord as the agent chord and of providing the automatic accompaniment which satisfy the requirement of the user.

In an aspect of the present invention, there is provided an automatic accompaniment apparatus having a chord designating section for designating a type of a chord; a pattern memory for storing a performance pattern formed by a series of note data corresonding to pitches of musical tones; a special operation designating section for designating a special operation; a pattern read out section for sequentially reading out the note data from the pattern memory; a note conversion section for carrying out a note correction operation corresponding to the type designated by the chord designating section on the note data read out by the pattern read out section when the special operation is not designated, and for outputting the note data read by the pattern read out section when the special operation is designated; and a musical tone signal generating section for generating musical tone signals based on the note data outputted by the note conversion section.

There is further provided an automatic accompaniment apparatus having a chord designating section for designating chords by roots and types of the chords wherein one of the types designates no-conversion; a pattern memory for storing a performance pattern which contains note data for designating tone pitches of musical tones; a pattern read out section for sequentially reading out the note data from the pattern memory; a note conversion section for carrying out a note correction operation corresponding to the root and the type designated by the chord designating section on the note data read out by the pattern read out means when the type of the chord designated by the chord designating section does not designates the no-conversion, and for outputting the note data read out by the pattern read out section when the type of the chord designated by the chord designating section designates the no-conversion; and a musical tone signal generating section for generating musical tones based on the note data outputted by the note conversion section.

There is further provided an automatic accompaniment apparatus having a chord designating means for designating a root, a type and an on-bass of a chord; a pattern memory for storing a chord performance pattern and a bass performance patterns, the both patterns including note data for designating tone pitches of musical tones; a pattern read out section for sequentially reading out the note data of the chord performance pattern and of the bass performance pattern; a detecting section for detecting a special relationship, which is defined with respect to root, type and on-bass, from the root, the type and the on-bass designated by the chord designating section; a note conversion section for carrying out a note correction operation corresponding to the root and the type designated by the chord designating section on the note data of the chord performance pattern read out by the pattern read out section, carrying out a note correction operation corresponding to the root, the type and the on-bass designated by the chord designating section on the note data of the bass performance pattern read out by the pattern read out section and outputting the note data of chord performance pattern and of the bass performance pattern thus corrected when the special relationship is detected by the detection section, and for carrying out a predetermined note correction operation on the note data of the chord performance pattern and of the bass performance pattern read out by the pattern read out section; and a musical tone signal generating section for generating musical tones based on the note data outputted by the note conversion section.

Further objects and advantages of the present invention will be understood from the following description of the preferred embodiments with reference to the drawing.

DETAILED DESCRIPTION OF THE PREFERRED EMBODIMENTS

A. Configuration of the preferred embodiment

Figure 1:
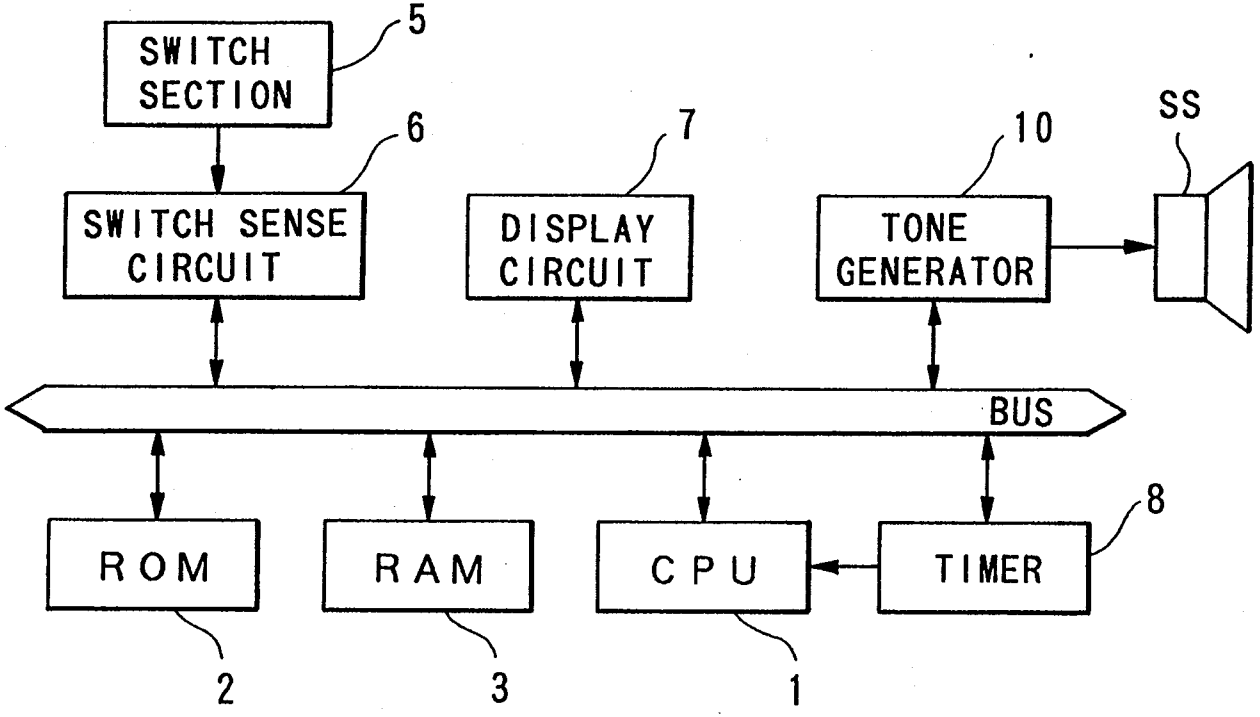
FIG. 1 is a block diagram showing the configuration of an automatic accompaniment apparatus of a preferred embodiment of the present invention.

FIG. 1 is a block diagram showing the configuration of an automatic accompaniment apparatus according to a preferred embodiment of the present invention. In FIG. 1, 1 designates a CPU (Central Processing Unit) which controls the other portions of the apparatus. 2 designates a ROM (Read Only Memory). The ROM 2 stores control programs which are used for CPU1 by controlling the other portions of the apparatus. The ROM 2 further stores pattern data of fundamental patterns which designate the tone pitches of the notes to be generated in the automatic performance and the sound timing of the notes. The ROM 2 further stores a note conversion table for converting the notes of the fundamental patterns to the other notes which are in harmony with the designated chord type. The detail description for the table will be given lator.

Figures 2, 3:
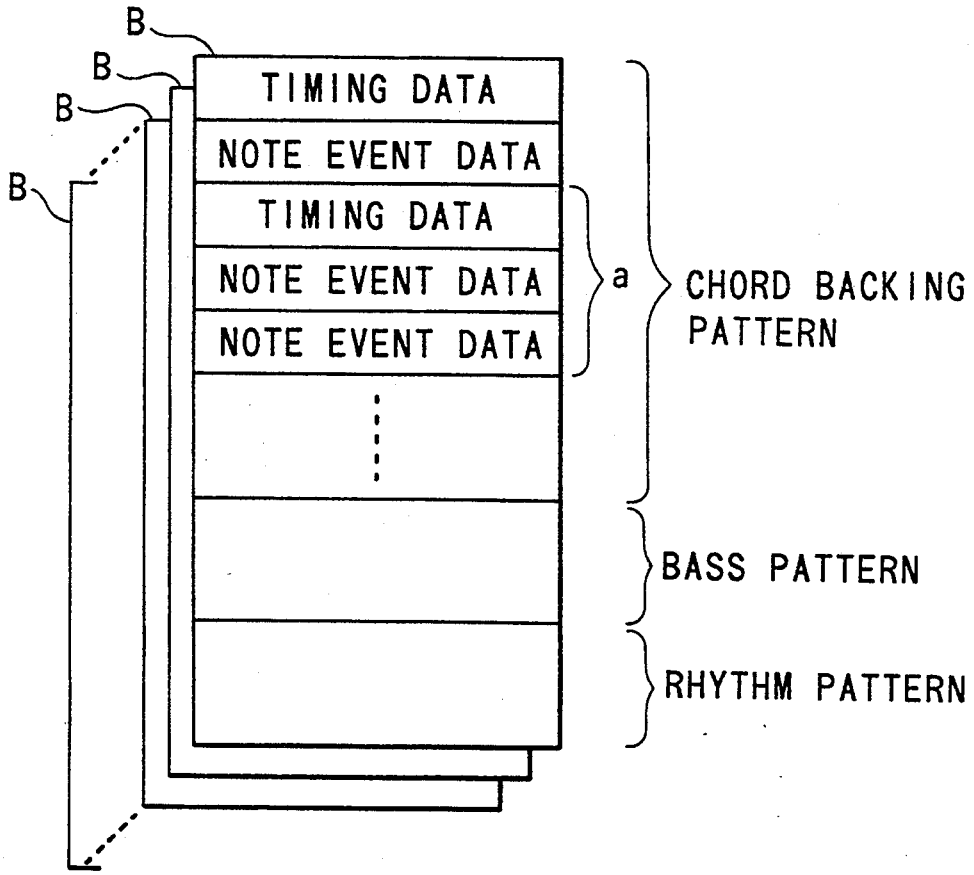
FIG. 2 shows the example of pattern data used for the preferred embodiment.
FIG. 3 shows the example of a note conversion table used for the preferred embodiment.

FIG. 2 shows the example of the pattern data. In FIG. 2, B, B . . . designate data blocks. In each one of these data blocks, three kinds of data consisting of a chord backing pattern, a bass pattern and a rhythm pattern are stored, each one of which contains the data for the accompaniment of one measure.

The chord backing pattern is used for the automatic accompaniment by chord sounds and is constructed of timing data and note event data as shown in FIG. 2.

Note event data consists of the following data:

a. note number
   The note number designates the tone pitch of the musical tone to be generated.
b. velocity data
   The velocity data designates the intensity of the musical tone to be generated.
c. gate time data
   The gate time data designates the duration of the musical tone to the generated.

The timing data designate the sound timing of the musical tones, and more specifically designate the duration time between the start timing of the measures and the sound timing of the corresponding musical tones. Basically, a musical tone is generated based on one pair of a note event data and a timing data. But, there are cases in which a plurality of musical tones are to be generated at the same time. In these cases, one timing data and a plurality of note event data are stored for the generation of such musical tones as indicated by "a" in FIG. 2.

The bass patterns designate the performance patterns of bass sounds and consist of the same kind of data as those of the chord backing pattern. The rhythm patterns designate the performance patterns of rhythm sounds (percussion sounds) and consist of the same kind of data as the above.

FIG. 3 shows the example of the content of the note conversion table. This note conversion table is used for converting the note numbers (tone pitches) of a predetermined notes. In the notes read out from the chord backing patterns or the bass patterns, the notes which are defined in this table are converted to the other notes based on the table.

In FIG. 3, "maj", "M", "m", . . . are indicated along to the row direction of the table. These symbols indicate the chord types of the chord, the notes of which are to be converted. Furthermore, "C", "C#", "D", . . . are indicated along to the column direction of the table. These symbols indicate the tone names. The note conversion table define the pitch shift values which are to be applied the tone names for the chord types shown in FIG. 3. The numerical value written in FIG. 3 indicate the pitch shift values. The pitch shift value "1" designates that the pitch of the musical tone is to be shifted upward by semitone. The shift value "2" designates that the pitch of the musical tone is to be shifted upward by whole tone. The shift value "−1" designates that the pitch of the musical tone is to be shifted downward by semitone. The shift value "−1" designates that the pitch of the musical tone is to be shifted downward by whole tone. The shift value "0" designates that the pitch of the musical tone is not to be shifted.

In the note conversion table shown in FIG. 3, the pitch shift values for a part of the chord types, for example, the pitch shift values for maj7, contains zeros as shift values for the almost tone names. But, since it is unsuitable for the generation of the natural chord sound to define all zeros as all shift values, the shift value −1 is defined for the tone name F in order to shift the tone pitch by semitone and to convert the tone into the tone E.

In the note conversion table, the patterns IIm7/V and IV/V designate the on-bass chords described above. If the key is C, the patterns IIm7/V and IV/V respectively correspond to the on-bass chords Dm7/G and F/G. In this apparatus, these on-bass chords are used as the agent chords of the chord type 7sus4 (this notation means that when the key is C, the chord type is G7sus4). Therefore, the pitch shift values for the chord types of the on-bass chords IIm/V and IV/V equal to the pitch shift values for the chord type of the chord 7sus4.

Next, in FIG. 1, 3 designates RAM (Random Access Memory). The storage areas of RAM 3 are used as the registers for storing the data relating to the control operations of the apparatus (these operations will be described later), and as pattern track areas, and as chord track areas, and as user's pattern data areas for storing the pattern data made by users. The pattern data stored in RAM 3 have the same information as the pattern data in ROM 2, which are shown in FIG. 2. The setting of pattern data to ROM 2 is carried out in the factory when the automatic accompaniment apparatus is product. The operation of setting pattern data to RAM 3 is carried out by users.

Figure 4:
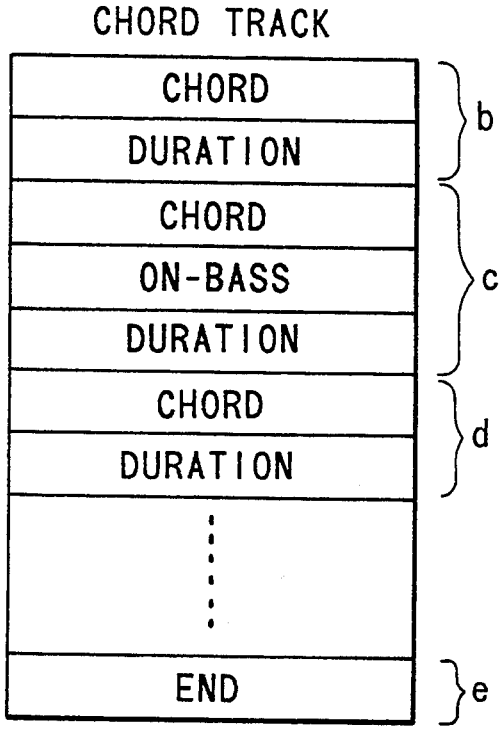
FIG. 4 shows the example of a chord track used for the preferred embodiment.

The chord track areas are used for storing chord track data which designate the chords constituting a musical piece. The chord track data are sequentially stored in the areas in accordance with the progress of the musical piece as shown in FIG. 4. Each chord track data basically consists of a pair of a chord data and a duration data as indicated by "b" and "d" in FIG. 4.

The duration data designates the duration between the present chord and the next chord, more specifically, the number of the beats between the chords.

The chord data consists of a root data which designates the root tone of the chord and a chord type data which designates the type of the chord. There are chord types of maj7, m7, M, etc. as general chord types which can be used in this apparatus. These chord types are designated by the chord type data. In this apparatus, a special chord type Thru can be designated by the chord type data in a predetermined case. The operation of this case will be described later.

The chord data is followed by the on-bass data as indicated by "c" in FIG. 4 when the on-bass chord is to be generated. The on-bass data designates the on-bass and the tone name (for example, C, C#, . . . B) of the bass tone.

The chord track data are terminated by an end data as indicated by "e" in FIG. 4, which indicates the ending of the musical piece.

Figure 5:
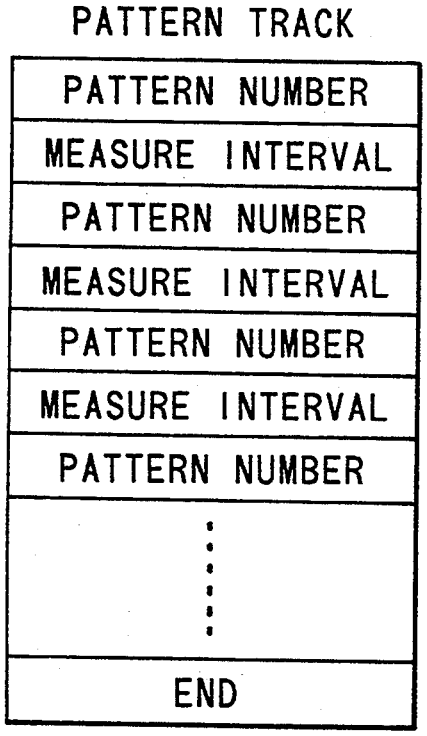
FIG. 5 shows the example of a pattern track used for the preferred embodiment.

Next, the description for the pattern track data will be given with reference to FIG. 5. The pattern track consists of a plurality of combinations of a pattern number and a measure interval data as shown in the drawing.

The pattern number is a data which designates one of the pattern data described above and consists of the serial number assigned to the pattern data to be designated. More specifically, pattern data are stored in the blocks B, B, . . . , B as shown in FIG. 2. The serial numbers are assigned to the pattern data block by block. These serial numbers are designated by the pattern numbers in the pattern track.

The measure interval is a data which designates the interval time at which the pattern of the accompaniment changes. In this embodiment, the pattern can be changed measure by measure. Therefore, the measure interval is defined as the number of the measures between the present measure and the next measure containing a new pattern which is different from the pattern of the present measure. Thus, when the pattern changes every measures, the measure interval is determined as 1 for all measures. The pattern track data are terminated by an end data as shown in FIG. 5 similarly to the chord track data.

Next, in FIG. 1, 5 designates a switch section consisting of a plurality of switches. Some swithes of the switch section are used for inputting commands to CPU 1 and the other switches are used for instructing the data transfer of data such as pattern data, pattern track data and chord track data from RAM 3 to CPU 1. The states of the switches in the switch section are sensed by a switch sense circuit 6 and the results are supplied to CPU 1. Furthermore, the setting and resetting of mode 1 (the description for mode 1 will be given later) are carried out through the operation of the switch section 5.

7 designates a display circuit which display an image under the control of CPU 1. A timer 8 generates tempo clocks which are used for the timing control of the tempo of the automatic accompaniment. In this embodiment, twenty four tempo clocks are generated by timer 8 during the period corresponding to one quarter note. The tempo clock thus generated are supplied to CPU 1 as interrupt signals.

10 designates a tone generator which generates musical tone signals under the control of CPU 1. In the tone generator 10, a plurality of sound channels are provided and a plurality of musical tone signals can be simultaneously generated through these sound channels. The musical tone signals generated by the tone generator are supplied to a sound system SS and outputted as musical sounds.

B. Operation of the automatic accompaniment apparatus (1) Main routine

Figure 6:
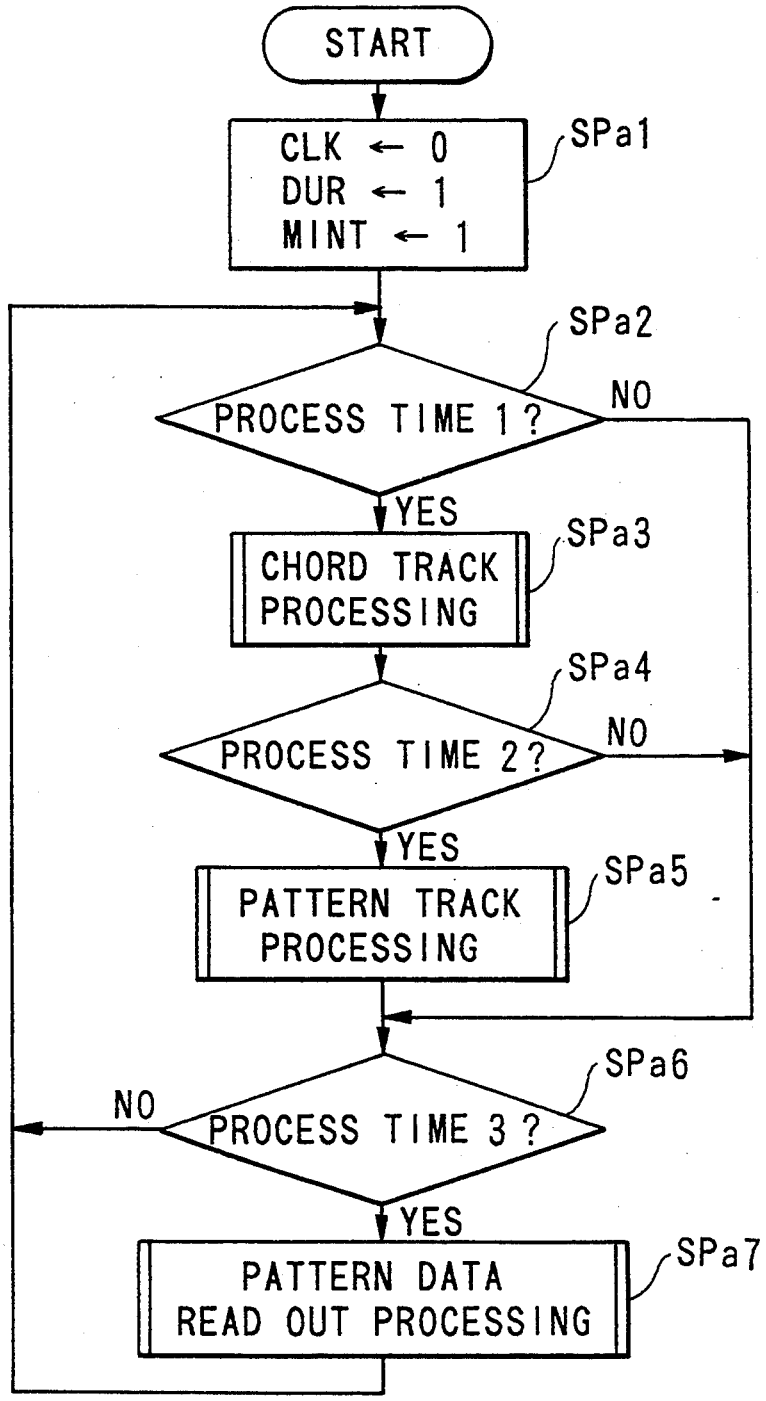
FIGS. 6 to 15 are flow charts showing the operations of the preferred embodiment.

FIG. 6 is the flow chart showing the main routine of the the automatic accompaniment processing carried out by the apparatus. The operation of the main routine will be described hereinbelow with respect to the example case in which the automatic accompaniment is performed by four quarters time.

First of all, in step SPa1, a initialization operation is carried out on registers CLK, DUR and MINT which are provided in the storage areas of RAM 3. The register CLK is used for storing the count value of the tempo clocks generated by timer 8. The register DUR is used for storing the duration data which is read out from the chord track areas (see FIG. 4). The register MINT is used for storing the measure interval which is read out from the pattern track areas (see FIG. 5). In the initialization, [0] is set to a register CLK and [1]s are set to registers DUR and MINT.

In steps SPa2, SPa4 and SPa6, judgements are made with respect to process times. The operations for the process times corresponding to the present time are then executed based on the results of the judgements.

Figure 7:
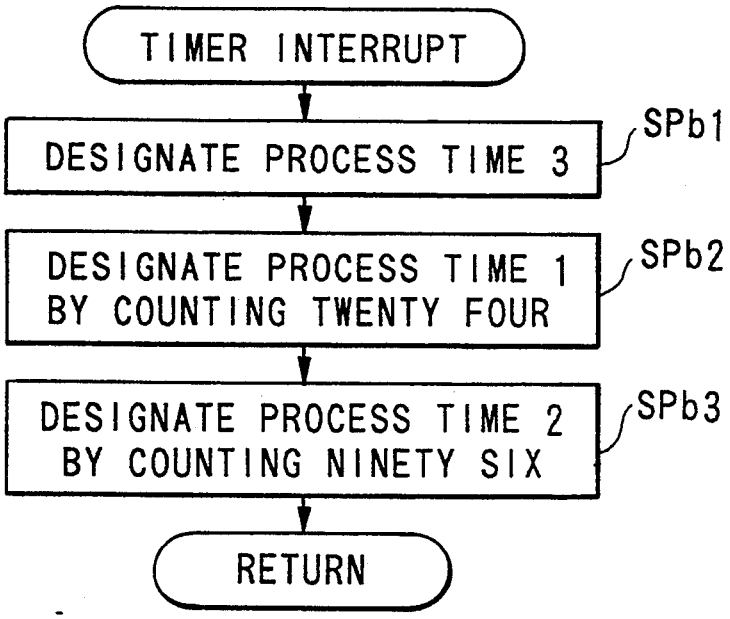

The process times are designated based on the count of the interrupt signals generated by timer 8. More specifically, the process time is designated through the procedure, the flow chart of which is shown in FIG. 7. As shown in FIG. 7, the process time 3 is designated by the operation of step SPb1 every time the CPU 1 has received one interrupt signal. The process time 1 is designated by the operation of step SPb2 every time the CPU 1 has received twenty four interrupt signals. The process time 2 is designated by the operation of step SPb3 every time the CPU 1 has ninty six interrupt signals. That is to say, the process time 3 is repeatedly designated in synchronization with the generation of tempo clocks, the generation timing of which determines the minimum resolution of the interval of the interrupt operations; the process time 1 is repeatedly designated in synchronization with the generation of beats, each one of which corresponds to twenty four clocks; and the process time 3 is repeatedly designated in synchronization with the generation of measures, each one of which corresponds to ninty six clocks.

In the main routine shown in FIG. 6, a judgement is made in step SPa2 as to whether the process time 1 is designated as the present process time or not. When the result of this judgement is [YES], the chord track processing routine is executed in step SPa3. After the completion of the operation in step SPa3, a judgement is made in step SPa4 as to whether the process time 2 is designated as the present process time or not. When the result of this judgement is [YES], the pattern track processing routine is executed in step SPa5. After the completion of the operation in step SPa5 or when the result of the judgement in step SPa2 or SPa4 is [NO], a judgement is made in step SPa6 as to whether the process time 3 is designated as the present process time or not. When the result of this judgement is [YES], the pattern data read out processing routine is executed in step SPa7. After the completion of the operation in step SPa7 or when the result of the judgement in step SPa6 is [NO], the procedure returns to step SPa2.

As mentioned above, the process times 1, 2 and 3 are respectively designated at the intervals corresponding to one beat, one measure and one tempo clock. Therefore, the chord track processing routine, the pattern track processing routine and the pattern data read out processing routine are executed at the intervals corresponding to one beat, one measure and one tempo clock. The start timing of each measure just corresponds to the start timing of the first beat in the measure. Therefore, at the start timing of each measure, the procedure sequentially proceeds to the all steps of SPa2 through SPa7, and the chord track processing routine, the pattern track processing routine and pattern data read out processing routine are executed.

(2) Pattern track processing routine

The operation of the pattern track processing routine will be described with reference to the flow chart of FIG. 8. In step SPc1 of the routine, a judgement is made as to whether the stored value of the register MINT is [1] or not. In the initialization of the apparatus, [1] is written in the register MINT as the initial value (step SPa1 in FIG. 6). Therefore, the result of the judgement in step SPc1 is [YES] when no writing operation is carried out on the register MINT after the initialization. When the result of the judgement in step SPc1 is [YES], the routine proceeds to step SPc2. In step SPc2, the first pattern number data is read out from the pattern track, which is as shown in FIG. 5, and the read out data is written in the register PTN. Next, the initial stage read out processing routine is executed in step SPc3.

Figure 9:
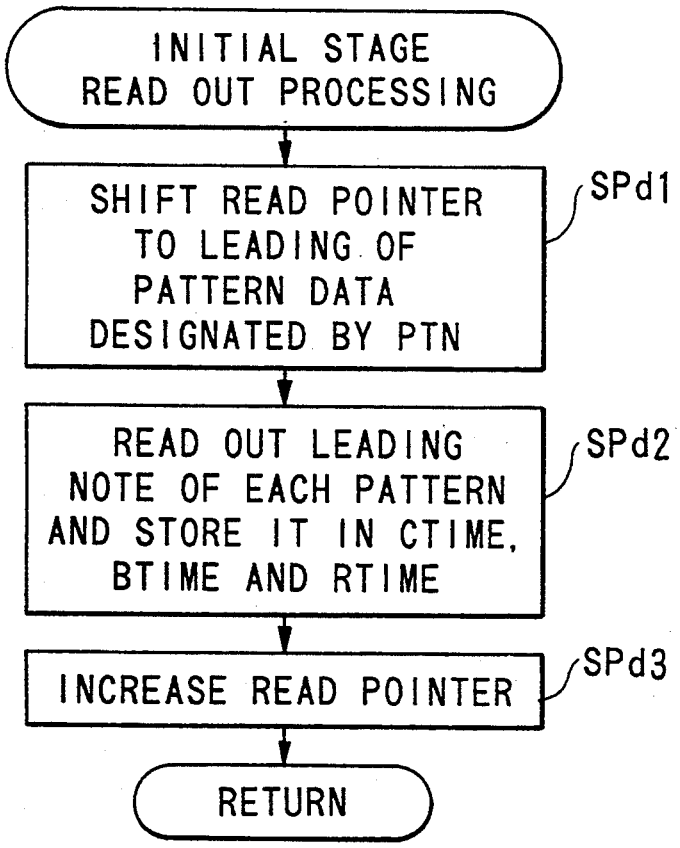

The read out processing routine consists of the operations of steps SPd1 to SPd3 as shown in FIG. 9. In step SPd1 of the routine, the leading address of the pattern data to be generated is determined based on the content of the register PTN, and the addresses thus determined are set to the read pointers. More specifically, the pattern to be generated is designated by the pattern number in the register PTN, and the block B corresponding to the designated pattern is determined, and the leading addresses of the chord backing pattern, and of the bass pattern, and of the rhythm pattern in the block B, are written in the read pointers.

Next, in step SPb2, the three data of the first timing data, which are the leading data of the chord backing pattern, of the bass pattern and of the rhythm pattern, are read out according to the read pointers and the read out data are stored in registers CTIME, BTIME and RTIME. Next, in step SPd3, the contents of the pointer registers are increased by one.

Figure 8:
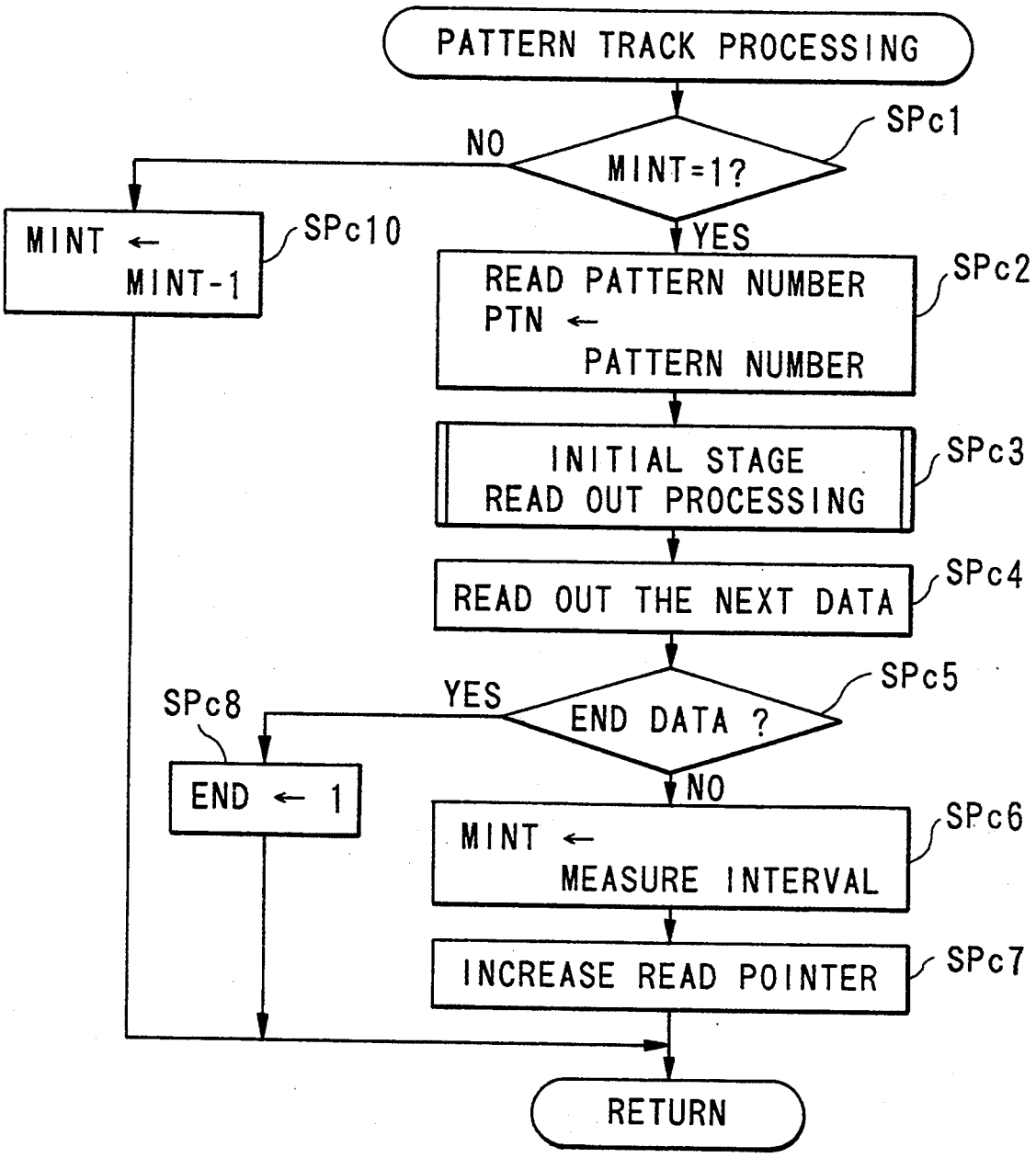

After the completion of step SPd3, the routine returns to step SPc4 of the pattern track processing routine shown in FIG. 8.

In step SPc4, the CPU 1 reads out the new data following to the pattern number data which has been read out in step SPc2. In this case, the measure interval data is generally read out as the new data in this case. However, the end data is read out as the new data when the generation of the musical piece ends.

Next, in step SPc5, a judgement is made as to whether the read out data is the end data or not. When the measure interval data is read out in step SPc4, the result of this judgement is [NO] and the routine thereby proceeds to step SPc6. In step SPc6, the measure interval data thus read out is stored in the register MINT. Next, in step SPc7, the content of the pointer for the pattern track is increased by one, after which the routine returns to the main routine. When the result of the judgement in step SPc5 is [YES], the routine proceeds to step SPc8 and the value [1] is thereby set to the register END, after which the routine returns to the main routine.

On the other hand, when the result of the judgement in step SPc1 is [NO], the routine proceeds to step SPc10. In step SPc10, the content of the register MINT is decreased by one, after which the routine returns to the main routine. Thereafter, when the pattern track processing routine is called again and the result of the judgement in step SPc1 [NO], only step SPc10 is executed and the routine returns to the main routine with no other operation. This process is repeated until the result of the judgement in step SPc1 becomes [YES]. The content of the register MINT is sequentially decreased by the execution of the pattern track processing routine. When the pattern track processing routine is called after the content of the register MINT has become [1], the above-described operations of steps SPc2 to SPc7 are executed.

The content of the register MINT becomes [1] when the interval time is counted out which is designated by the measure interval data. Therefore, the judgement in step SPc1 can be written as "whether the interval time designated by the measure interval data has been counted out or not".

(3) Chord track processing routine

Next, the operation of the chord track processing routine will be described with reference to FIGS. 10 and 11.

In step Spe1, a judgement is made as to whether the content of the register DUR is [1] or not. In the initialization of the apparatus, [1] is written in the register DUR as the initial value (step SPa1 in FIG. 6). Therefore, the result of the judgement in step SPe1 is [YES] and the routine thereby proceeds to step SPe3. In step SPe3, the chord data read out processing is executed in which the first chord data is read out from the chord track areas shown in FIG. 4; the root data contained in the chord data is stored in the register ROOT; and the type data contained in the chord data is stored in the register TYPE. Next, in step SPe4, the next data is read out.

In this case, a duration data or an on-bass data may be read out as the next data. In step SPe5, a judgement is made as to whether the on-bass data has been read out or not. When the result of this judgement is [NO], i.e., when the duration data has been read out, the routine proceeds to step SPe6 and the duration data thus read out is thereby written in the register DUT. Next, in step SPc7, the data for indicating of that no on-bass data is given (hareinafter, this state will be called as "no on-bass"), is designated is written in the register BASS.

On the other hand, when the result of the judgement in step SPe5 is [YES], the routine proceeds to step SPe9. In step SPe9, the on-bass data (in this case, the on-bass data is a tone name) is written in the register BASS. Next, in step SPe10, the data following to the previous read out data is read out. It is no doubt that the read out data is the duration data. Therefore, the read out data is stored in the register DUR in step SPe11. Next, in step SPe12, a judgement is made as to whether the relationship of the contents of the registers ROOT, TYPE and BASS satisfies the relationship of IIm7/V or of IV/V at any keys (tonalities) or not. That is to say, judged in step SPe12 is whether the contents of registers ROOT, TYPE and BASS correspond to any one of Dm7/G or F/G (at key C), Em7/A or G/A (key D), . . . and C#m7/F# or E/F# (key B) or not. When the result of this judgement is [YES], the operation in step SPe8 is executed.

Figure 11:
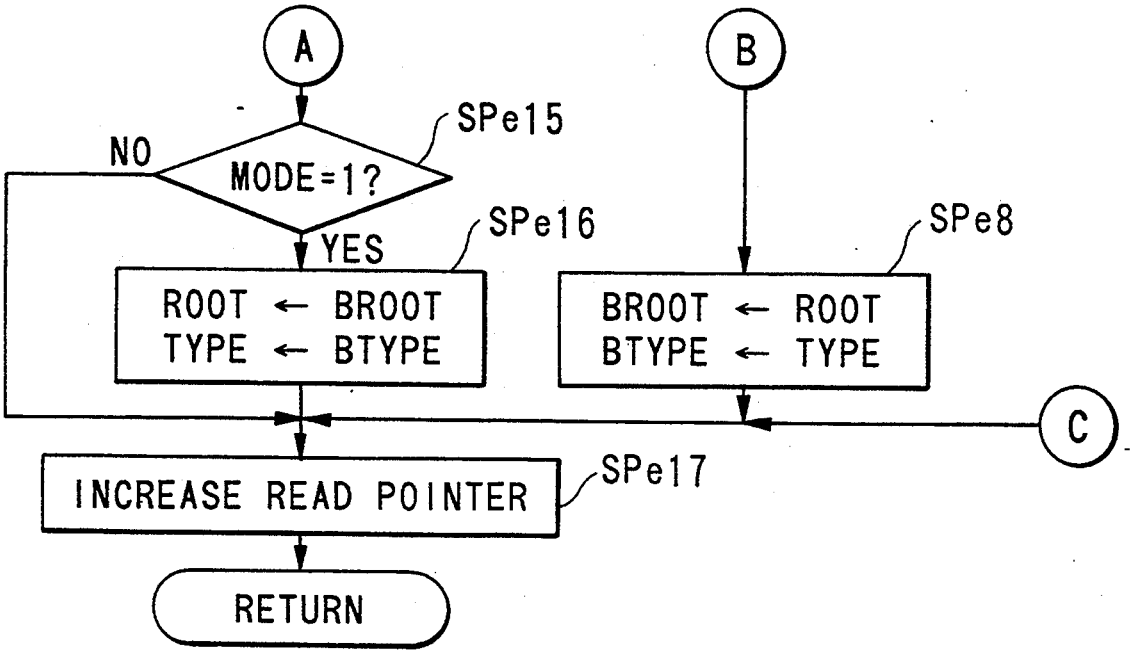
Figure 12:
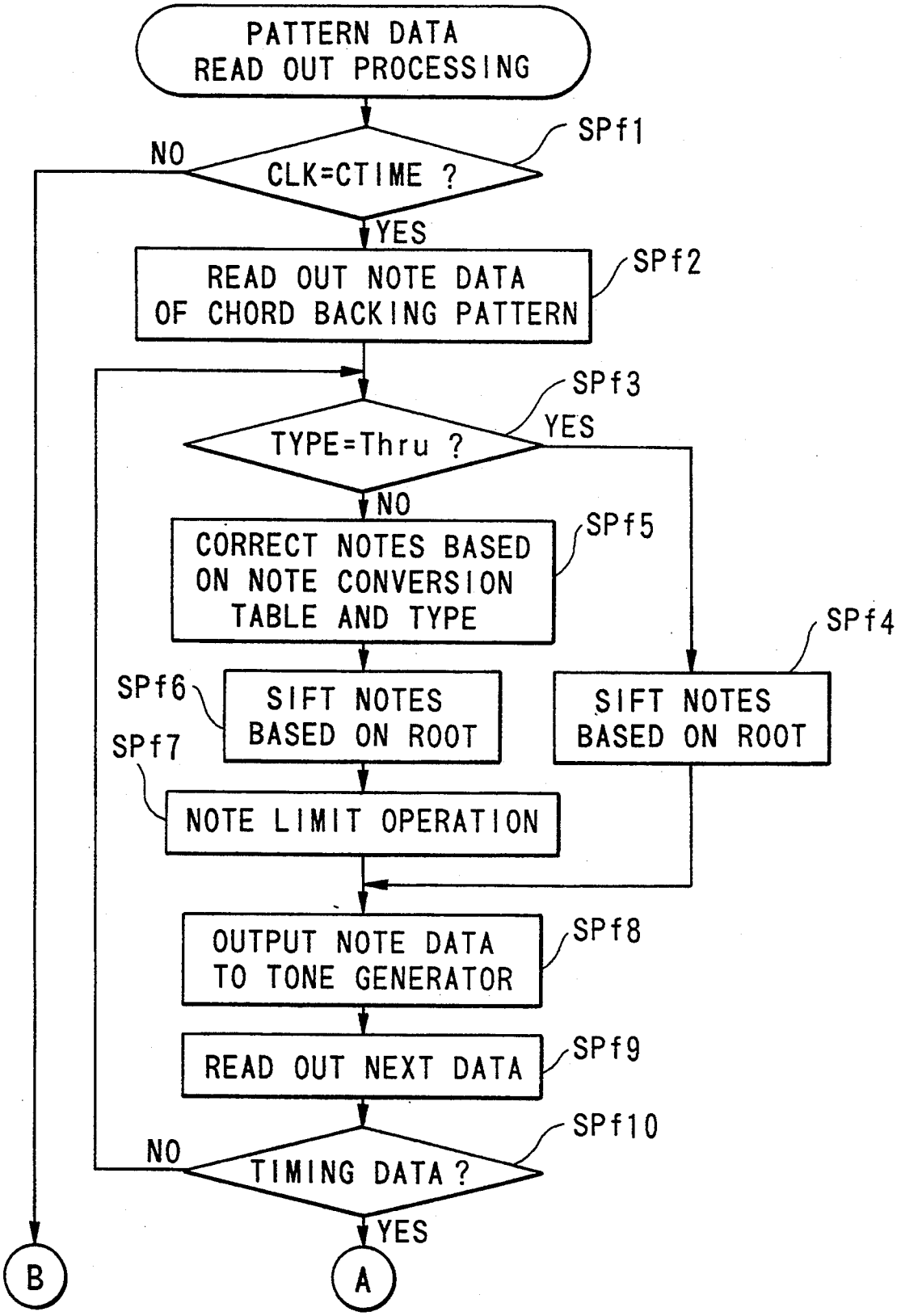

On the other hand, when the result of the judgement in step SPe12 is [YES], the routine proceeds to step Spe13 in FIG. 11. In step SPe13, the bass tone name is transferred from the register BASS to the register BROOT and the chord type, which corresponds to the bass tone name and is IIm7/V or IV/V, is transferred to the register BTYPE. Next, in step SPe14, the data for indicating "no on-bass" is written in the register BASS. The symbols IIm7/V or IV/V indicates the chord type and the number of semitones. However, these are used for designating the chord type by correlating the tone name designated as on-bass to the root. In this embodiment, the same transformation as to the transformation of V7sus4 which is the object of the agent are executed in the both cases of IIm7/V and IV/V as shown in FIG.

3. The transformation may be modified in such a manner that the music is not broken.

Figure 10:
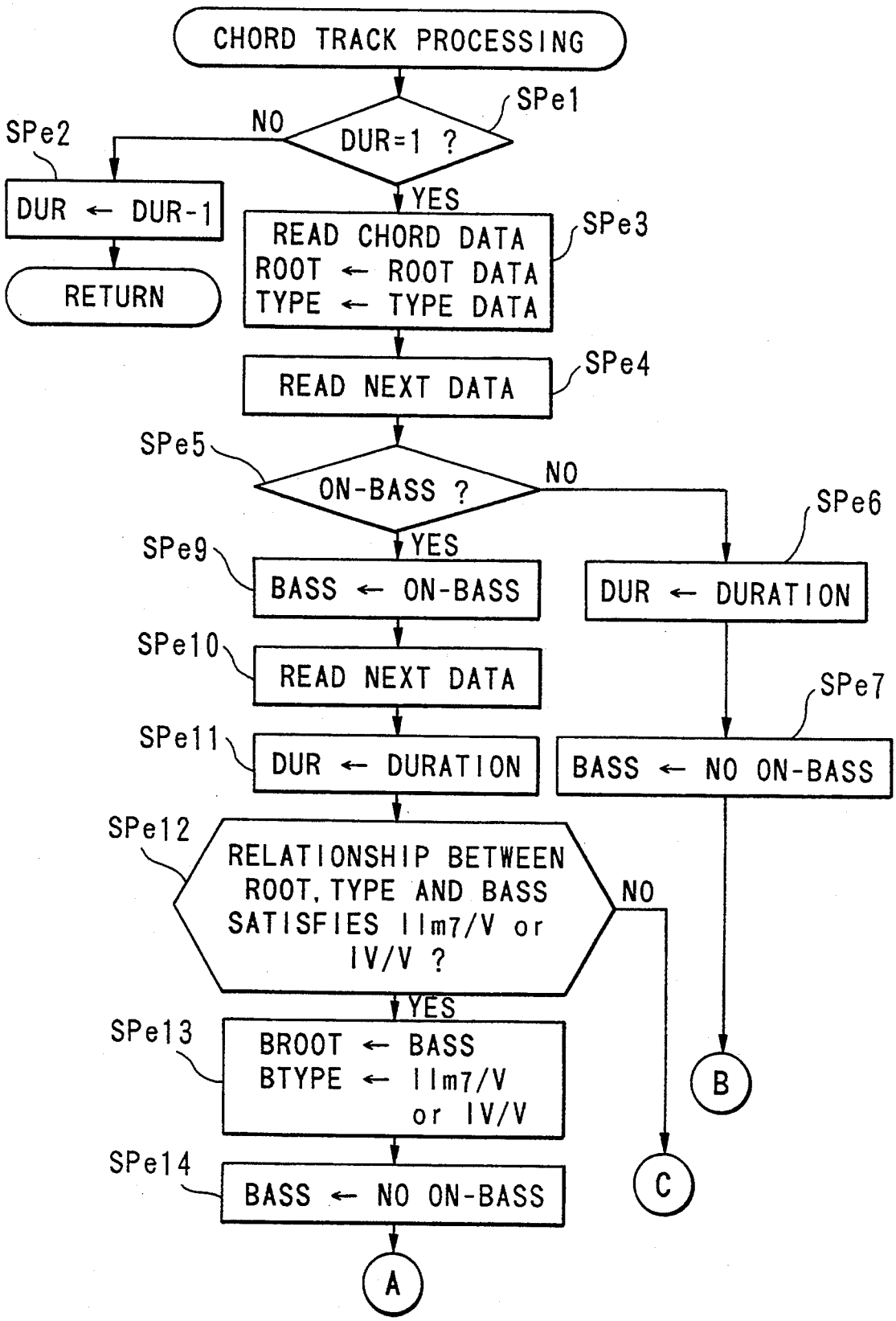

The operations shown in the flow chart of FIG. 10 are be summarized as follows:

In the case where no on-bass data is read out, the data for indicating "no on-bass" is stored in the register BASS and the routine proceeds to the operation labeled by "B" The data for indicating "no on-bass" is used as the control data for the general automatic accompaniment which will be described later.

In the case where an on-bass data for generating an agent chord is read out, the root and the type for the agent chord are respectively stored in the registers BROOT and BTYPE for the bass performance; the data for indicating "no on-bass" is stored in the register BASS; and the routine proceeds to the operation labeled by "A". The root and the type thus stored are subjected the later-procedure which uses the conversion table for the agent chord shown in FIG. 3.

In the case where an on-bass data for generating the on-bass chord is read out, the data for indicating "on-bass" is stored in the register BASS and the routine proceeds to the operation labeled by "C". The data "on-bass" thus stored is used for the identification of the general on-bass accompaniment In the later-procedure.

FIG. 11 shows the flow of the later-procedure of the procedure shown in FIG. 10. In FIG. 11, the labels "A", "B" and "C" are indicated in order to clarify the connection between the procedure of FIG. 10 and the procedure of FIG. 11.

When the routine proceeds to step SPe8 labeled by "B", the root data in the register ROOT and the type data in the register TYPE are respectively transferred to the registers for the bass performance BROOT and BTYPE in order to perform the general accompaniment.

When the routine proceeds to step SPe15 labeled by "A", a judgement is made as to whether the value [1] is stored in the register MODE or not. When the result of this judgement is [YES], the routine proceeds to step SPe16. In step SPe16, the contents in the registers for the bass performance BROOT and BTYPE are respectively transferred to the registers for chord backing BROOT and BTYPE.

In this manner, the special root and type which conform with the agent chord are set by the above-described operation of step SPe16 described-above.

In contrast, when the result of the judgement in step SPe15 is [NO], such special root and type are not set for the chord backing and the special setting for the bass performance (step SPe13) is only executed. The content of the register MODE is changed by the operation of the above-described switch section.

When the result of the judgement in step SPe15 is [NO], or when the above-described operations of step SPe8 or SPe16 has been completed, the routine proceeds to step SPe17. In step SPe17, the read pointer for the chord track is increased by one, after which the routine returns to the main routine.

On the other hand, when the result of the judgement in step SPe1 is [NO], the content of the register DUR is decreased by one and the routine immediately returns to the main routine without the other operations described above. Thereafter, only the operation of step SPe2 is repeated and the content of the register DUR is thereby decreased until the result of the judgement in step SPe1 becomes [YES]. When the chord track processing routine is called after the content of the register DUR has become [1], the result of the judgement in step SPe1 becomes [YES] and the procedure consisting of step SPe3 and steps following to the step is thereby executed. That is to say, judged in step SPe1 is whether the duration time designated by the duration data has been counted or not and is the same judgement as the judgement in step SPc1.

(4) Pattern data read out processing routine

Next, the description will be given with respect to the pattern read out processing routine. In this processing routine, the pattern data corresponding to the pattern number which is designated through the operations of the pattern track processing routine and the tone pitches of the tones to be regenerated are determined based on the root, the chord type and the on-bass which are designated through the operations of the chord track processing routine. The tone generation timing of each tone is controlled based on the timing data contained in the pattern data.

First of all, in step SPf1, a judgement is made as to whether the content of the register CLK equals the content of the register CTIME or not. The register CTIME stores the timing data corresponding to the first note of the chord backing pattern which is read out by the operation of step SPd2 (FIG. 9). Therefore, if the result of the judgement in step SPf1 is [YES], such a result indicates that the present time is the tone generation timing at which the first note is to be generated. Thus, the tone generation procedure consisting of step SPf2 and the steps following to the step are executed.

In step SPf2, the note data of the chord backing pattern is read out. Next, in step SPf3, a judgement is made as to whether the chord type data [Thru] his stored in the register TYPE or not. When the result of this judgement is [YES], the routine proceeds to step SPf4 to shift the tone pitch of the note data based on the root stored in the register ROOT.

In contrast, when the result of the judgement in step SPf3 is [NO], data are read out from the note conversion table (FIG. 3) corresponding to the chord type stored in the register TYPE and the tone pitches of the note data are corrected based on the values of the read out data (1, −1, . . . ). In this case, when a value of a element of the conversion table is [0], the tone pitch of the tone corresponding to the element is not corrected. Next, the tone pitches of chord sounds are shifted based on the root stored in the register ROOT, after which the note limit processing operation is executed in steps SPf6 and SPf7. The note limit processing operation is a procedure for limiting the tone pitches of the notes within a predetermined range. When the tone pitches are out of the range by the shift operation of the tone pitches, the tone pitches are shifted back to the range by an octave so as to be return within the range through the operations of the note limit processing.

After the operation of step SPf7 or SPf4, the routine proceeds to step SPf8 to supply the note data to the tone generator 10 (FIG. 1). As a result, the musical tone corresponding to the note data is generated by the sound system SS.

In this manner, when the chord type is [Thru], only the tone pitch shift operation based on the root is carried out on the chord backing data and the operation results are generated as the musical tones, whereas when the chord type is not [Thru], the tone pitches of the notes of the chord backing data are corrected based on the chord pattern which is designated through the chord track processing routine, and the tone shift operation based on the root is carried out on the corrected tone pitches and the results are generated as the musical tones.

Figure 13:
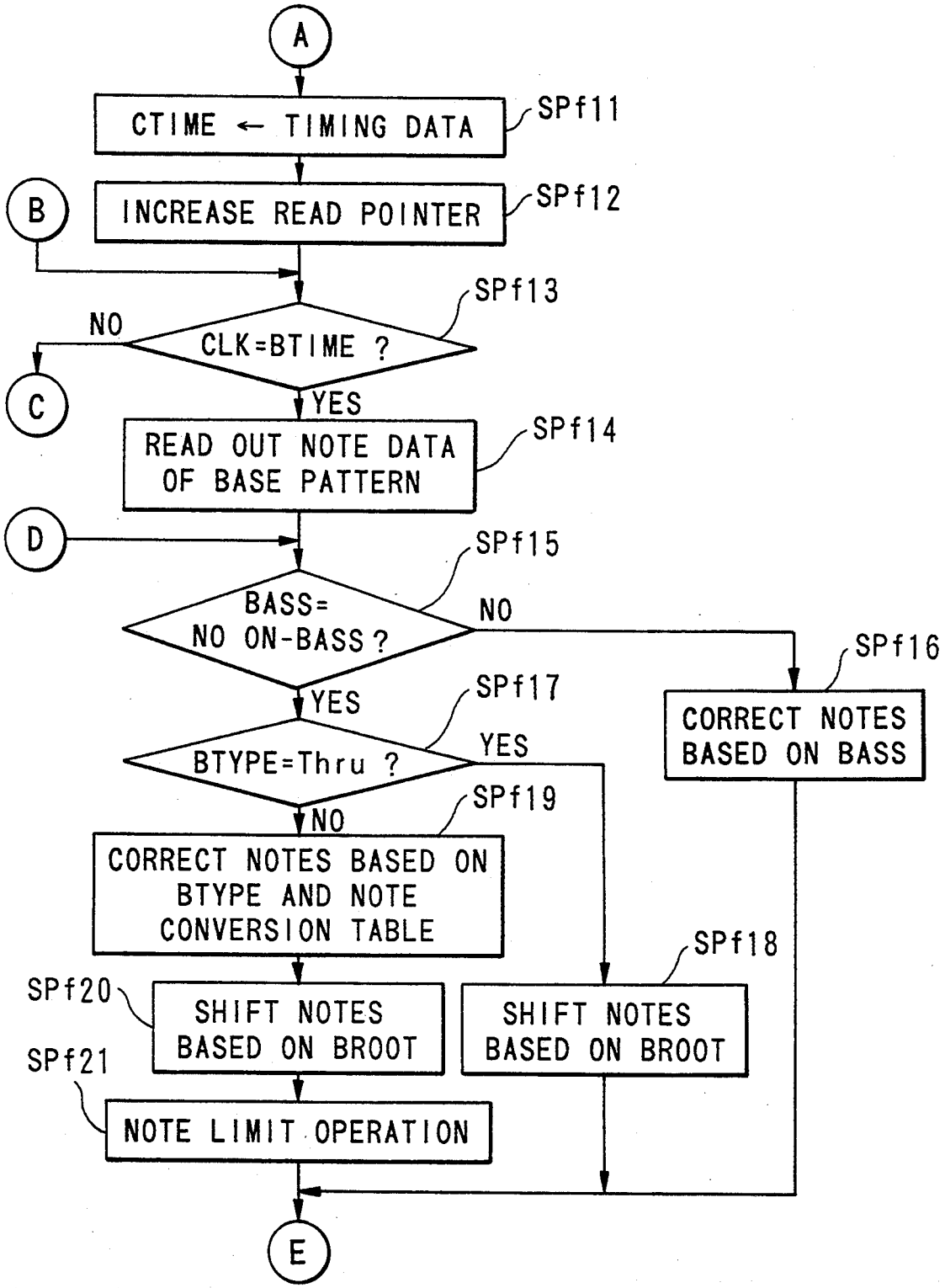
Figure 14:
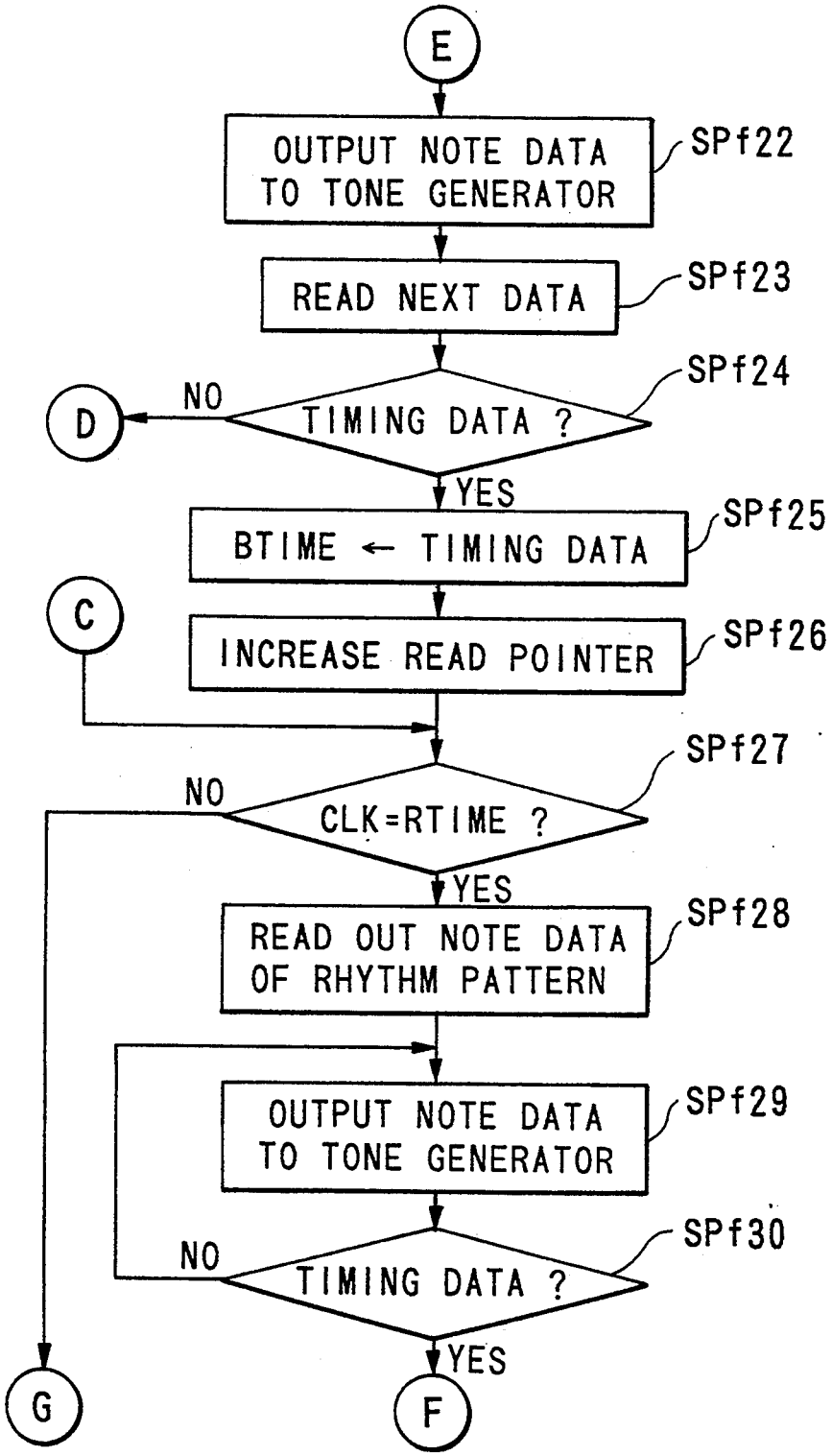
Figure 15:
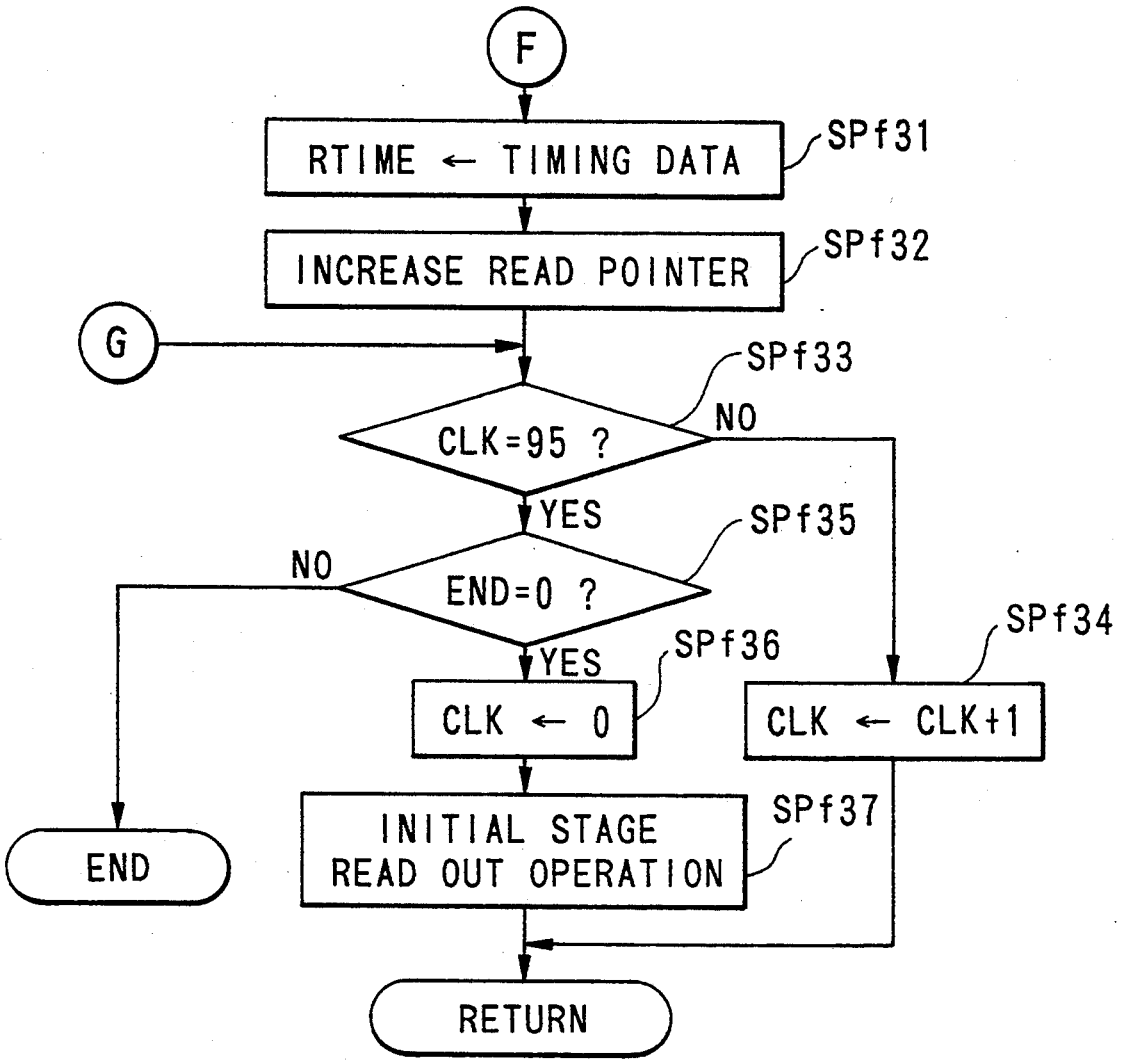

Next, in step SPf9, the data following to the previous read out data is read out. Timing data is generally read out as the new data in this case. However, there are cases in which a plurality of tones are to be generated at the same timing. In these cases, the note data is read out as the above new data. For this reason, a judgement is made in step SPf10 as to whether the read out data is the timing data or not. When the result of this judgement is [YES], the above-described operations of steps SPf3 to SPf10 are executed again. When the result of the judgement in step SPf10 is [YES], the routine proceeds to step SPf11 shown in FIG. 13 to store the read out data in the register CTIME. Next, the content of the read pointer for the chord backing pattern is increased by one (step SPf12) after which the routine proceeds to step SPf13.

On the other hand, when the result of the judgement in step SPf1 is [NO], i.e., the present time is still before the tone generation timing, the routine immediately proceeds to step SPf13. In step SPf13, a judgement is made as to whether the content of the register CLK equals the content of the register BTIME or not, i.e., whether the present time is at the tone generation timing of the next note data of the bass pattern or not.

When the result of this judgement is [YES], the note data of the bass pattern is read out in step SPf14, after which a judgement is made in step SPf15 as to whether the register BASS stores the data indicating "no on-bass" or not. When the result of this judgement is [NO], the present case corresponds to the above-described case labeled by "C" in FIG. 10. In this case, the routine proceeds to step SPf16 to correct the tone pitch of the read out note data by the tone pitch stored in the register BASS. That in to say, the tone pitch of the bass pattern is ignored and the tone pitch of the read out note data is forcibly set to the bass tone pitch of the tone name designated by the on-bass. The bass tone pitch in this case is preferably in the key range which is appropriate for bass sounds.

On the other hand, when the result of the judgement in step SPf15 is [YES], a judgement is made in step SPf17 as to whether the content of the register BTYPE is [THRU] or not. When the result of this judgement is [YES], the routine proceeds to step SPf18 to shift the tone pitches of the note data based on the tone pitch of the root stored in the register BROOT.

When the result of the judgement in step SPf17 is [NO], the tone pitches of the note data are corrected based on the note conversion table which corresponds to the pattern stored in the register BTYPE (step SPf19), after which the tone pitch thus corrected is shifted based on the tone pitch of the root stored in the register BROOT (step SPf20), after which the note limit processing operation is executed (step SPf21).

After the completion of step SPf16, SPf18 or SPf21, the note data thus obtained through the above operations is supplied to the tone generator 10 to output the corresponding bass sounds by the sound system SS.

By the above procedure, when the on-bass is designated, the bass tones are generated at the tone pitches designated by the on-bass. When the designated type is [Thru], the notes of the bass pattern are subjected only to the pitch shift processing operation and the results are generated as the bass sounds, whereas when the designated type is not [Thru], the notes of the bass pattern are subjected to the tone pitch correction operation based on the pattern which is designated through the chord track processing routine, after which the notes thus corrected are subjected to the tone pitch shift operation and the results are outputted as the bass sounds.

Next, in step SPf23, the next data is read out. This data is generally timing data. But, when a plurality of musical tones are to be generated at the same timing, the note data may be read out as this data. For this reason, a judgement is made in step SPf24 as to whether the data read out in step SPf23 is a timing data or not. When the result of this judgement is [NO], the above-described operations are carried out again because a plurality of tones are to be generated, whereas when the result of the judgement is [YES], the operations of step SPf25 and the steps following to the step are carried out.

Next, in step SPf25, the timing data thus read out is stored in the register BTIME. Next, the content of the read pointer is increased by one (step SPf26), after which the routine proceeds to step SPf27.

When the present time Is not the tone generation timing which is designated by the previous read out timing data, the result of the judgement in step SPf13 is [NO] and the routine thereby immediately proceeds to step SPf27. Next, in step SPf27, a judgement is made as to whether the content of the register CLK equals the content of the register RTIME or not. This judgement Is rewritten as whether the present time is the tone generation timing, at which the musical tone designated by the next note data in the rhythm pattern is to be generated, or not.

When the result of this judgement is [YES], the note data of the rhythm pattern is read out and supplied to the tone generator 10 (steps SPf2, 29). The next data is then read out and a judgement is made as to whether the data thus read out is the timing data or not (step SPf30).

When the read out data is not the timing data, the read out data is the note data. In this case, the note data is also supplied to the tone generator 10. When the read out data is the timing data, the routine proceeds to step SPf11 to store the timing data in the register RTIME. Next, the content of the read pointer is increased by one (step SPf12), after which the routine proceeds to step SPf33. On the other hand, when the result of the judgement in step SPf27 is [NO], the routine immediately proceeds to step SPf33 since the present time is earlier than the tone generating timing at which the next rhythm tone of the rhythm pattern is to be generated.

In step SPf33, a judgement is made as to whether the value stored in the register CLK is [95] or not, i.e., whether the one measure of the performance has been achieved or not. When the result of this judgement is [NO], the content of the register CLK is increased by one and the routine then returns to the main routine (step SPf35).

On the other hand, when the result of the judgement in seep SPf33 is [YES], a judgement is made as to whether the content of the register END is [0] or not (step SPf35). When the result of this judgement is [NO], i.e., when the end mark is detected through the pattern track processing routine (steps SPc5, SPc8 in FIG. 8), the pattern data read out operation is ended because the present time is the ending timing at which the automatic accompaniment of the musical piece is to be ended. More specifically, the content of the register END is changed to [1] when the last pattern data is read out (step SPc8). After this, when the one measure of the performance has been performed and the routine then proceeds to step SPf35, the judgement in this step SPf35 is [NO] and the automatic accompaniment is thereby ended. When the result of the judgement in step SPf35 is [YES], the register CLK is initialized in order to count the number of measures, after which the initial read out processing is carried out and the routine returns to the main routine (steps SPf36, 37).

The initial read out processing is the operation shown in FIG. 9. In this operation, when the pattern has changed, the leading timing data of the new pattern is read out, whereas when the pattern has not changed, the leading timing data of the same pattern is read out.

C. Modification of the embodiment

The present invention does not restricted within the above-described preferred embodiment. Hereinbelow, the description will be given with respect to the modifications of the embodiment.

(1) In the above-described embodiment, the note conversion table is not used when the chord type [Thru] is designated. Instead of this, the note conversion table, the contents of which are all zeros, may be used when the chord type [Thru] is designated. Furthermore, In the above-described embodiment, the shift operation is carried out based on the root stored in the register ROOT even If the chord type [Thru] is designated. However, such a shift operation may be omitted.

(2) In the above-described embodiment, the code [Thru] is used as the chord type. Instead of tills, thru-on/off flag, which is a flag corresponding to the chord type [Thru], may be defined as root data or type data to control the possibility of the designation of [Thru].

(3) In the above-described embodiment, the special conversion is carried out on the on-bass-chord Dm7/G and F/G. But, the special conversion may be carried out on the other chords, for example, Dm/F (the agent chord of F6), and on the chords except for the agent chords.

(4) In the note conversion table of the above-described embodiment, the elements corresponding to the chord 7sus4 equal the elements corresponding to the chords IIm7/V and IV/V. However, there may be difference between the elements of these chords. In this case, however, the same types of conversions should be carried out on the chords so that the chords similar to the 7sus4 are obtained by the conversions. Furthermore, the elements corresponding to the 7sus4 may be used for converting the chords IIm7/V and IV/V in order to convert the notes of the chords in the same manner.

(5) In the above-described embodiment, the same note conversion table is referenced for chord backing patterns and for the bass patterns. However, the two note conversion tables may be employed for the chord backing patterns and for the bass patterns.

(6) In the above-described embodiment, the data format is shown in which the on-bass designation data are stored at the necessary positions. However, a data format may be used in which a chord data is stored with an on-bass data so as to form a pair.

(7) The chord may be designated in a real time manner by the keyboard for example. In this case, [Thru] is also designated in a real time manner by operational means such as a switch.

What is claimed is:

1. An automatic accompaniment apparatus comprising:

chord designating means for designating a root and a type of a chord;

pattern memory means for storing a performance pattern containing note data which designate tone pitches of musical tones;

special operation designating means for designating a special operation;

pattern read out means for sequentially reading out the note data from the pattern memory means;

note conversion means for carrying out a note correction operation corresponding to the type designated by the chord designating means on the note data read out by the pattern read out means when the special operation is not designated, and for outputting the note data read by the pattern read out means when the special operation is designated; and musical tone signal generating means for generating musical tone signals based on the note data outputted by the note conversion means.

2. An automatic accompaniment apparatus according to claim 1, wherein said chord designating means designates a root of the chord and the note conversion means carries out the note correction operation by converting a note to another note among the note data in accordance with the root designated by the chord designating means.

3. An automatic accompaniment apparatus according to claim 2 wherein the chord designating means comprises:

a chord memory for sequentially storing a series of chords each of which is comprised by a root and a type, in accordance with a progress of a musical piece; and chord read out means for sequentially reading out the roots and the types.

4. An automatic accompaniment apparatus according to claim 2 wherein the special operation designating means designates a special chord consisting of a root and a special type when the special operation is designated.

5. An automatic accompaniment means according to claim 4 wherein the note conversion means further carries out a note correction operation corresponding to the root of the special chord on the note data read out by the pattern read out means.

6. An automatic accompaniment apparatus comprising:

chord designating means for designating chords by roots and types of the chords wherein one of the types designates no-conversion;

pattern memory means for storing a performance pattern which contains note data for designating tone pitches of musical tones;

pattern read out means for sequentially reading out the note data from the pattern memory means;

note conversion means for carrying out a note correction operation corresponding to the root and the type designated by the chord designating means on the note data read out by the pattern read out means when the type of the chord designated by the chord designating means does not designates the no-conversion, and for outputting the note data read out by the pattern read out means when the type of the chord designated by the chord designating means designates the no-conversion; and musical tone signal generating means for generating musical tones based on the note data outputted by the note conversion means.

7. An automatic accompaniment apparatus according to claim 6 wherein the note conversion means further corrects the note data based the root of the chord designated by the chord designating means when the type of the chord designates the no-conversion.

8. An automatic accompaniment apparatus according to claim 6 wherein the chord designating means comprises:

a chord memory for sequentially storing roots and types of chords in accordance with a progress of a musical piece; and chord read out means for sequentially reading out the roots and the types from the chord memory.

9. An automatic accompaniment apparatus comprising:

chord designating means for designating a root, a type and an on-bass of a chord;

pattern memory means for storing a chord performance pattern and a bass performance patterns, the both patterns including note data for designating tone pitches of musical tones;

pattern read out means for sequentially reading out the note data of the chord performance pattern and of the bass performance pattern;

detecting means for detecting a special relationship, which is defined with respect to root, type and on-bass, from the root, the type and the on-bass designated by the chord designating means;

note conversion means for carrying out a note correction operation corresponding to the root and the type designated by the chord designating means on the note data of the chord performance pattern read out by the pattern read out means, carrying out a note correction operation corresponding to the root, the type and the on-bass designated by the chord designating means on the note data of the bass performance pattern read out by the pattern read out means and outputting the note data of chord performance pattern and of the bass performance pattern thus corrected when the special relationship is detected by the detection means, and for carrying out a predetermined note correction operation on the note data of the chord performance pattern and of the bass performance pattern read out by the pattern read out means; and musical tone signal generating means For generating musical tones based on the note data outputted by the note conversion means.

10. An automatic accompaniment apparatus according to claim 9 wherein the chord designating means comprises:

a chord memory for sequentially storing roots and types of chords in accordance with a progress of a musical piece; and chord read out means for sequentially reading out the roots and the types from the chord memory.

11. An automatic accompaniment apparatus according to claim 9 wherein the note conversion means comprises a note conversion table which defines tone pitch shift values for notes and carries out the note correction operation based on the note conversion table.

12. An automatic accompaniment apparatus according to claim 9 wherein the note conversion means comprises a note conversion table for the on-bass and carries out the note correction operation based on the note conversion table for the on-bass when the root, the type and the on-bass of the chord satisfy a predetermined relationship.

13. An automatic accompaniment apparatus according to claim 9 wherein when the root, the type and the on-bass are designated by the chord designating means and the special relationship is detected by the detection means, the designated on-bass is used as a root of a new chord.

14. An automatic accompaniment apparatus according to claim 9 further comprising selecting means for selecting to carry out a predetermined note correction operation on only the note data of the bass performance pattern or to carry out the note correction on the note data of the chord performance pattern and of the bass performance pattern when the special relationship is detected.

* * * * *